US007707682B2

(12) United States Patent
Parr

(10) Patent No.: US 7,707,682 B2
(45) Date of Patent: May 4, 2010

(54) CLEANING MACHINE FOR CLEANING A SURFACE WITH EDGE CLEANING CAPABILITY

(75) Inventor: Richard S. Parr, Uniontown, OH (US)

(73) Assignee: Techtronic Floor Care Technology Limited, Road Town, Tortola (VG)

( * ) Notice: Subject to any disclaimer, the term of this patent is extended or adjusted under 35 U.S.C. 154(b) by 1335 days.

(21) Appl. No.: 10/741,616

(22) Filed: Dec. 19, 2003

(65) Prior Publication Data

US 2005/0132524 A1 Jun. 23, 2005

(51) Int. Cl.
*A47L 9/04* (2006.01)
*A47L 7/00* (2006.01)

(52) U.S. Cl. ..... 15/320; 15/364; 15/385

(58) Field of Classification Search ..... 15/320, 15/364, 385, 322
See application file for complete search history.

(56) References Cited

U.S. PATENT DOCUMENTS

| | | | | | |
|---|---|---|---|---|---|
| 1,938,068 | A | * | 12/1933 | Deutscher | 15/320 |
| 3,699,607 | A | * | 10/1972 | Putt | 15/320 |
| 3,978,539 | A | * | 9/1976 | Yonkers | 15/42 |
| 4,167,799 | A | * | 9/1979 | Webb | 15/320 |
| 4,219,902 | A | * | 9/1980 | DeMaagd | 15/364 |
| 4,887,330 | A | * | 12/1989 | Woodhall et al. | 15/322 |
| 4,984,328 | A | | 1/1991 | Berfield | 15/322 |
| 5,443,362 | A | | 8/1995 | Crites et al. | |
| 5,517,715 | A | | 5/1996 | Monson | 15/320 |
| 5,524,320 | A | | 6/1996 | Zachhuber | 15/320 |
| 5,611,106 | A | * | 3/1997 | Wulff | 15/320 |
| 5,867,857 | A | | 2/1999 | Crouser et al. | |
| 5,911,261 | A | | 6/1999 | Farone et al. | 15/416 |
| 5,970,572 | A | * | 10/1999 | Thomas | 15/320 |
| 6,009,593 | A | * | 1/2000 | Crouser et al. | 15/320 |
| 6,189,177 | B1 | | 2/2001 | Shook et al. | 15/320 |
| 6,253,414 | B1 | * | 7/2001 | Bradd et al. | 15/320 |
| 6,378,162 | B1 | * | 4/2002 | Zahuranec et al. | 15/320 |
| 6,421,874 | B1 | | 7/2002 | McCormick | 15/364 |
| 6,514,356 | B2 | | 2/2003 | Vystrcil et al. | 134/21 |
| 6,550,098 | B2 | | 4/2003 | Roberts et al. | |
| 6,735,812 | B2 | * | 5/2004 | Hekman et al. | 15/320 |
| 7,117,556 | B2 | | 10/2006 | Grey | |
| 7,146,682 | B2 | | 12/2006 | Damman et al. | |
| 7,225,501 | B2 | * | 6/2007 | Gordon et al. | 15/320 |
| 7,290,309 | B2 | | 11/2007 | Rocke | |
| 2002/0073504 | A1 | * | 6/2002 | Hall et al. | 15/320 |
| 2003/0226230 | A1 | | 12/2003 | Hertrick et al. | 15/320 |
| 2004/0068829 | A1 | * | 4/2004 | Rocke | 15/398 |
| 2004/0148731 | A1 | * | 8/2004 | Damman et al. | 15/388 |
| 2004/0221406 | A1 | * | 11/2004 | Grey | 15/42 |

* cited by examiner

*Primary Examiner*—Theresa T Snider
(74) *Attorney, Agent, or Firm*—Michael Best & Friedrich LLP

(57) ABSTRACT

A portable cleaning apparatus for cleaning a surface is provided and includes a housing for movement along the surface. A solution container is mounted to the housing and contains a solution. A dispensing nozzle is provided on the housing and is fluidly connected to the solution container. The dispensing nozzle dispenses solution beyond the edge of the housing. In one aspect, an edge cleaner is provided at an edge of the housing and includes a plurality of pliable elements for agitating the surface, wherein the pliable elements contact the surface beyond the edge of said housing.

15 Claims, 5 Drawing Sheets

CLEANING MACHINE FOR CLEANING A SURFACE WITH EDGE CLEANING CAPABILITY

BACKGROUND OF THE INVENTION

1. Field of the Invention

The present invention relates to a cleaning machine for cleaning a surface with edge cleaning capability.

2. Background Information

It is known to have cleaning machines for cleaning a surface. Generally, these machines utilize a suction nozzle and/or brush assembly to clean the surface. Yet, many of these cleaning machines due to their compact design cannot clean confined areas such as edges and corners and other difficult to reach areas of the surface. Such edge cleaning capability has been implemented in cleaning machines of the upright vacuum cleaner types such as that disclosed in U.S. Pat. Nos. 6,514,356 and 5,911,261. The present invention improves edge-cleaning performance on cleaning machines that distribute cleaning solution on the surface. The present invention also provides a cleaning machine that imparts movement or rotation to an edge cleaner connected thereto for improved edge cleaning performance.

SUMMARY OF THE INVENTION

The foregoing and other facets of the present invention will be readily apparent from the following description and the attached drawings. In one aspect of the invention, a portable cleaning apparatus for cleaning a surface in which cleaning solution is dispensed to the surface and substantially simultaneously extracted along with the dirt on the surface in a continuous operation is provided. The portable cleaning apparatus includes a housing and a distributor operatively connected to the housing for distributing cleaning solution to the surface. A solution container is removably mounted to the housing and fluidly connected to the distributor for supplying a flow of cleaning solution to the distributor. A recovery tank is removably mounted to the housing and a suction nozzle is secured to the housing and in fluid communication with the recovery tank for transporting the cleaning solution and dirt from the surface into the recovery tank. A suction source is in fluid communication with the suction nozzle and recovery tank for drawing the cleaning solution and dirt from the surface through the suction nozzle and into the recovery tank. An edge cleaner is provided at an edge of the housing and includes a plurality of pliable elements for agitating the surface, wherein the pliable elements contact the surface beyond the edge of said housing.

In another aspect of the invention, a portable cleaning apparatus for cleaning a surface is provided and includes a housing for movement along the surface. A solution container is mounted to the housing and contains a solution. A dispensing nozzle is provided on the housing and is fluidly connected to the solution container. The dispensing nozzle dispenses solution beyond the edge of the housing.

In still another aspect of the invention, a portable cleaning apparatus for cleaning a surface is provided and includes a housing. A recovery container is removably mounted to the housing and a suction nozzle, secured to the housing, is in fluid communication with the recovery container for transporting the dirt and particles from the surface into the recovery container. A suction source is in fluid communication with the suction nozzle and recovery container for drawing the dirt and particles from the surface through the suction nozzle and into the recovery container. An edge cleaner, operatively connected to the housing, includes a brush rotatably connected to the housing. The brush includes a plurality of pliable elements for agitating the surface, wherein the pliable elements contact the surface beyond the edge of said housing.

BRIEF DESCRIPTION OF THE DRAWINGS

The invention will now be described, by way of example, with reference to the attached drawings, of which.

DETAILED DESCRIPTION OF THE INVENTION

Figure 1:
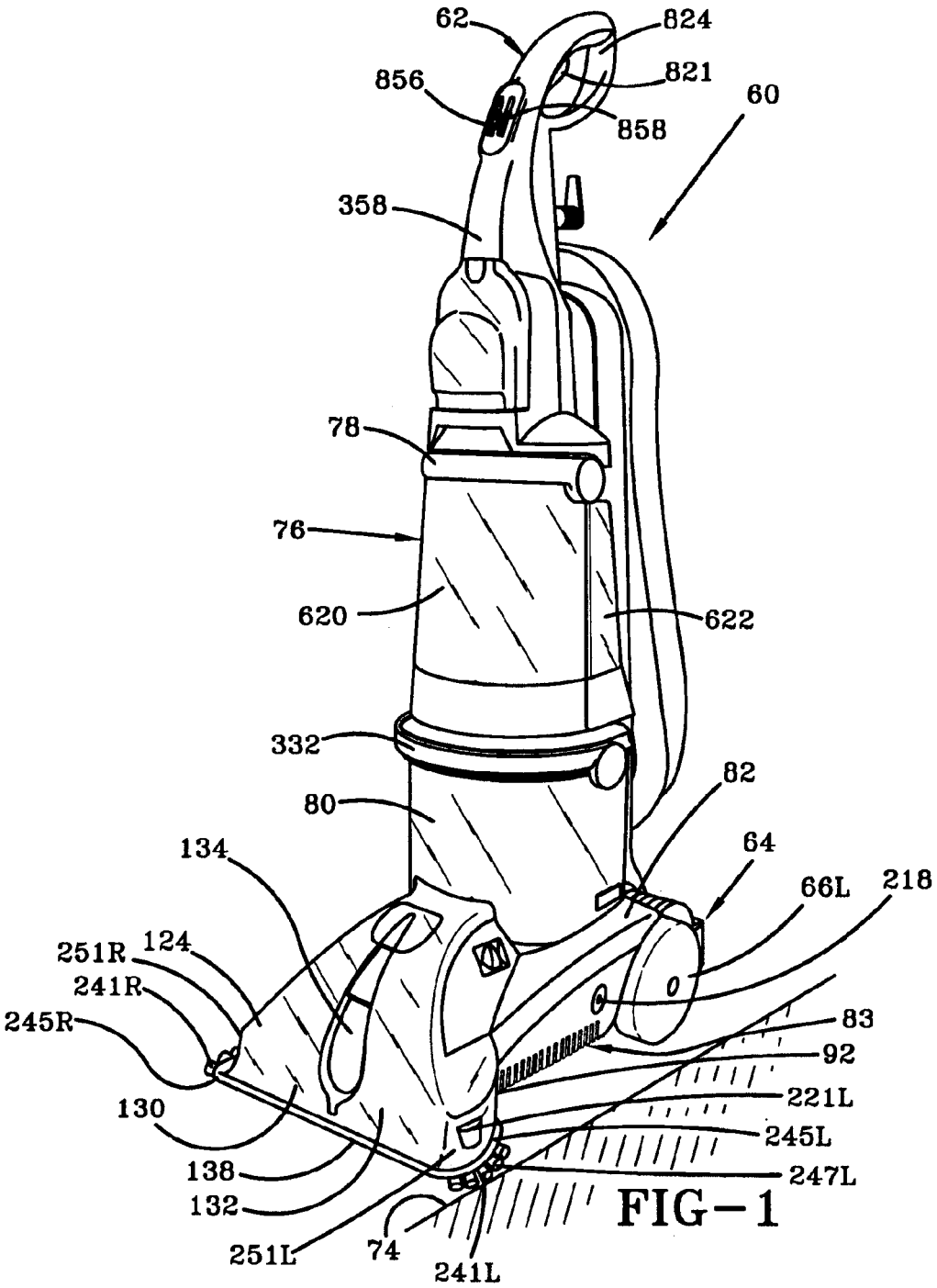
FIG. 1 is a perspective view of a carpet extractor embodying the present invention.

Referring to the drawings, FIG. 1 depicts a perspective view of a portable cleaning apparatus in the form of an upright carpet extractor 60 according to one embodiment of the present invention. The upright carpet extractor 60 comprises an upright handle assembly 62 pivotally connected to the rear portion of the floor-engaging portion or base assembly 64 that moves and cleans along a surface 74 such as a carpet or bare floor. A supply or solution tank assembly 76 is removably mounted to the handle assembly 62 of the extractor 60.

Figure 2:
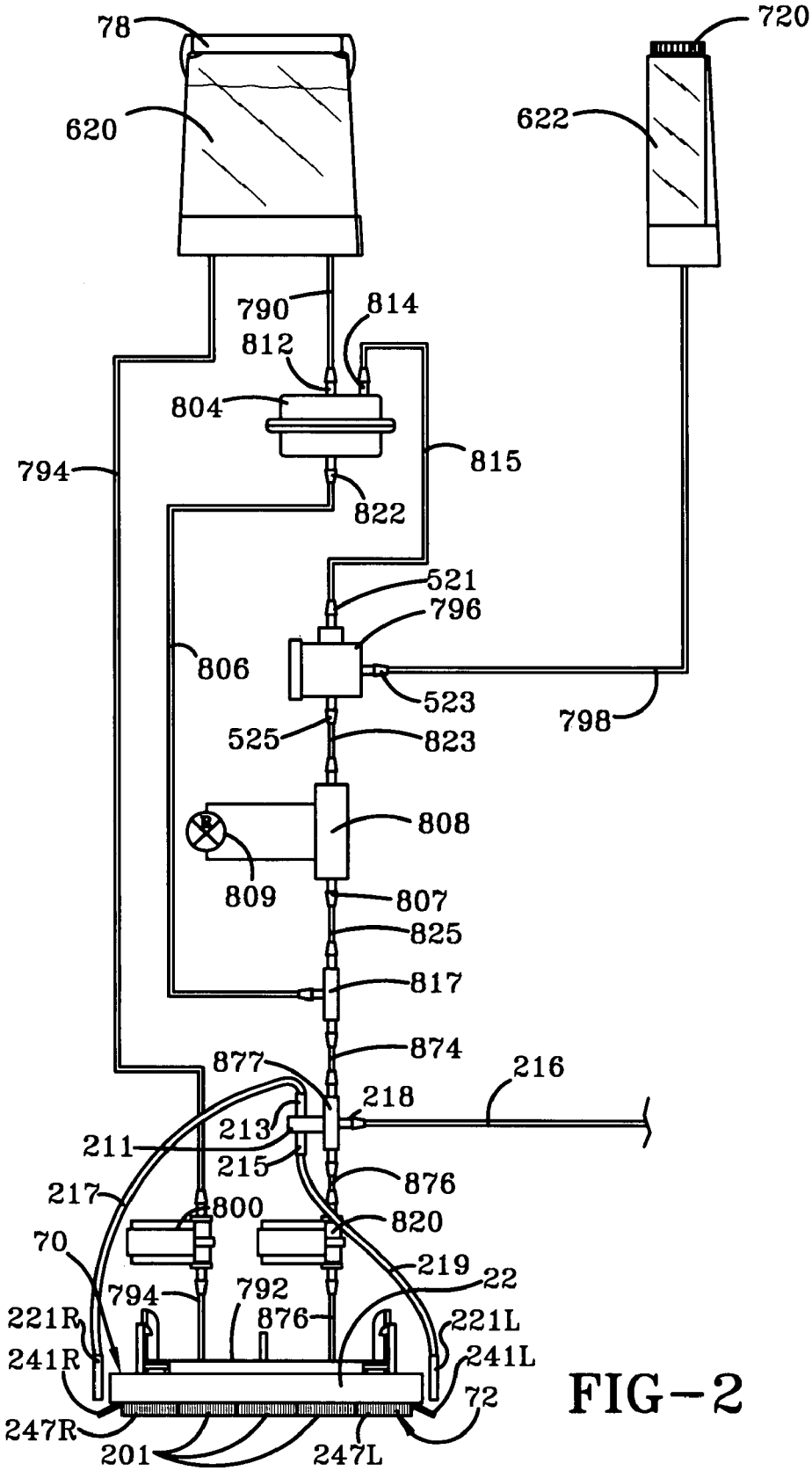
FIG. 2 is a schematic view of the fluid distribution system of the embodiment shown in FIG. 1.

The base assembly 64 includes two laterally displaced wheels 66 (only the left wheel 66L being shown) rotatably attached thereto. A combined air/water separator and recovery tank 80 with carrying handle 332 removably sets atop a motor/fan assembly 90 (FIG. 3 from co-pending application having Ser. No. 10/165,731 and U.S. Publication No. 20030226230, which has subsequently gone abandoned, the disclosure being incorporated herein by reference) of base assembly 64 and is surrounded by a hood portion 82. The base assembly 64 includes a frame 83 having a front body 92 defining a skirt that partially covers a brush assembly 70 (FIG. 2). The front body 92 has translucent opposite side portions 251R, 251L for viewing the brush assembly 70 (FIG. 2).

A floor suction nozzle assembly 124 is removably mounted to the hood portion 82 of the base assembly 64 and is in fluid communication with the recovery tank 80 for transporting air and liquid into the recovery tank 80. The floor suction nozzle assembly 124 includes a front plate secured to a rear plate that in combination define dual side ducts 130, 132 separated by a tear drop shaped opening 134. The inlet 138 of the suction nozzle assembly 124 extends around and slightly beyond the side portions 251 of the front body 92 defining side nozzle ends 245L, 245R of the inlet 138.

As depicted in FIG. 2, the base assembly 64 includes the brush assembly 70, which has a plurality of rotating gear scrub brushes 201, 247 for scrubbing the surface 74. In particular, the brush assembly 70 comprises brush support beam 22. Rotatingly received within the brush support beam are gear brushes 201, 247, which rotate generally along an axis perpendicular to the surface 74 upon which the base assembly 64 is positioned. Each gear brush is basically configured as a spur gear, which intermeshes with its adjacent gear brush such that when the center gear brush rotates all other gear brushes rotate accordingly. For gear brushes 201, each gear tooth has a blind bore, extending to an offset, into which bristle bundles are compressively inserted and extend downwardly to the surface. For the outer gear brushes 247L and 247R, each gear tooth has a blind bore, extending to an offset, into which bristle bundles 241L and 241R are compressively inserted.

As seen in FIG. 1, these bristle bundles 241 extend downwardly and slope or flare outwardly beyond their respective side portions 251. This orientation allows the bristle bundles 241 to access edges, corners and other difficult places to scrub. Other details of this brush assembly 70 are taught in U.S. Pat. No. 5,867,857, the disclosure of which is incorporated herein by reference. Brush assembly 70 is operated by a suitable gear train (or other known means). A suitable air turbine driven gear train is taught in U.S. Pat. No. 5,443,362, the disclosure of which is incorporated by reference. Other types of brush assemblies could be used instead such as, for example, a horizontal brush roll or fixed brush assembly with the outer bristle bundles extending downwardly and sloping or flaring outwardly beyond the edge of their respective side portions 251. Also, other pliable elements can be used in lieu of the bristle bundles 241.

Figure 4:
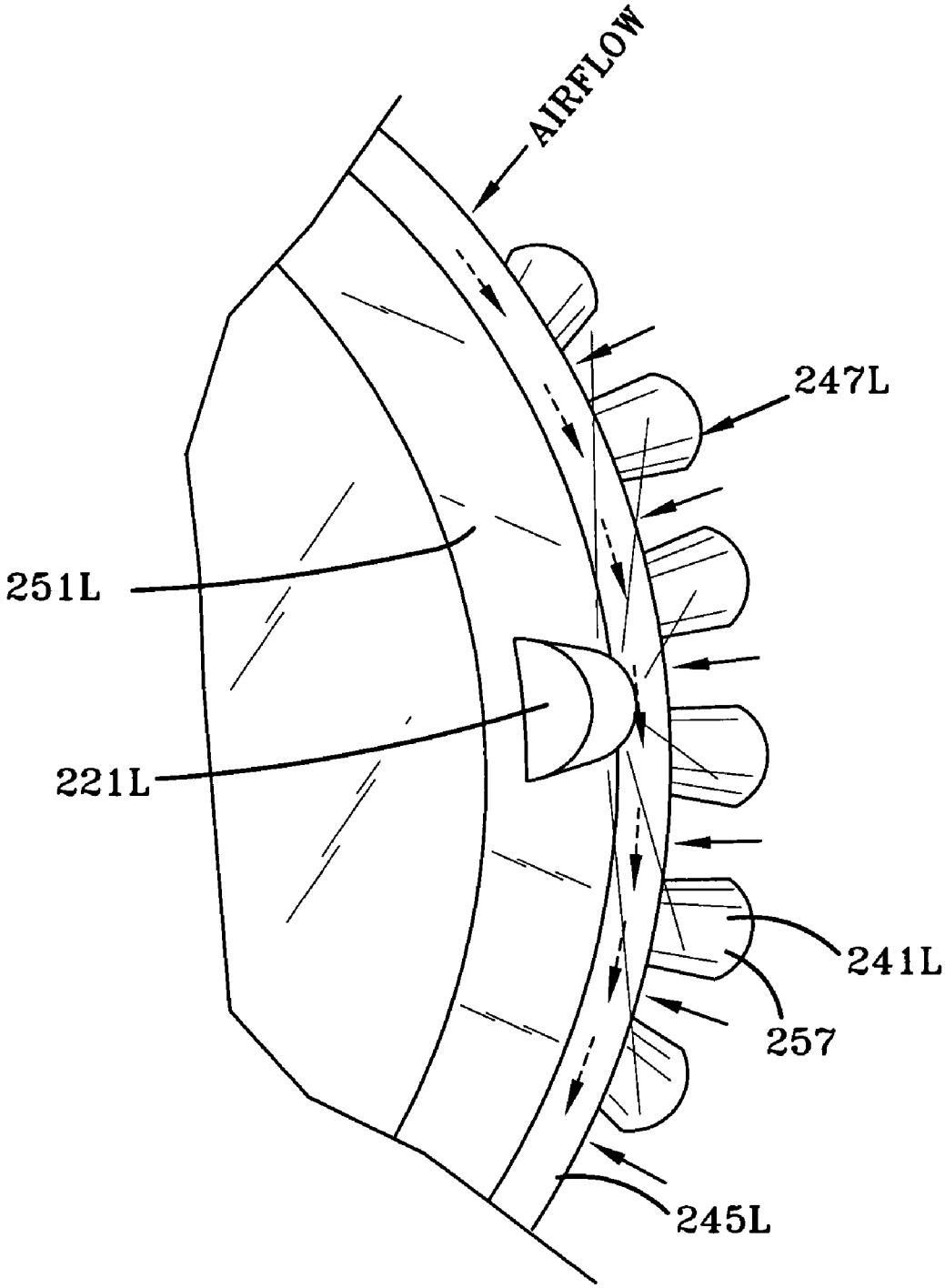
FIG. 4 is an enlarge top and left side perspective view of a portion of the base assembly of FIG. 1 showing the spray nozzle and other nearby elements of the invention.

Spray nozzles 221L and 221R are affixed to their respective side portions 251L, 251R for spraying or distributing cleaning solution to the bristle bundles 241 of the outer gear brushes 247. Each spray nozzle has a generally semicircular top with the sides tapering down to define a generally semi-frustoconical shape. As depicted in FIG. 4, the left spray nozzle 221L is designed and constructed to spray cleaning solution in a fanning pattern down to the exposed portion 257 of the bristle bundles extending beyond the side portion thereby wetting them. Thus, as the wetted bristle bundles 241 scrub the surface, cleaning solution from them is distributed onto the surface. The right spray nozzle 221R is of a similar design and sprays the cleaning solution in a similar pattern on the bristle bundles 241R as the left spray nozzle. The spray nozzles 221 can also be designed to distribute the cleaning solution so that it cascades down the side portions 251 and wets the bristle bundles 241.

The supply tank assembly 76 comprises a clean water supply tank 620 and a detergent supply tank 622 with cap 720 (FIGS. 2 and 3) adhesively mounted to the clean water supply tank 620 as depicted in FIG. 1. The supply tank assembly 76 includes a combination carrying handle and tank securement latch 78 providing a convenient means for carrying the tank and/or securing the tank to the extractor handle assembly 62.

Referring to FIG. 2, the carpet extractor 60 includes a solution hose 794 that fluidly connects the clean water tank 620 to a shut off valve 800 used for selectively turning on and off the flow of clean water. Another solution hose 790 fluidly connects the water tank 620 to an inlet 812 of a pressure actuated shut off valve 804. A solution hose 798 fluidly connects the detergent tank 622 to an inlet 523 of the mixing Tee 796. A second shut off valve 820 is used for selectively turning on and off the flow of mixed water and detergent cleaning solution through distributor 792. Both shut off valves 800, 820 are fluidly connected to the distributor 792 through their respective solution hoses 794, 876. The shut off valves 800, 820 are in the form of solenoid valves, however, other types of valves could also be used.

The pressure actuated shut off valve 804 is fluidly connected between the clean water tank 620 and the mixing Tee 796 for turning off and on the flow of water. This shut off valve 804 is opened and closed by outside pressure via a conduit 806 connected between it and the outlet 807 of a pump 808 through a Tee 817. The valve 804 includes a pressure port 822 fluidly connected to the outlet 807 of a pump 808. The outlet 814 of the valve 804 is fluidly connected to an inlet 521 of the mixing Tee 796 via hose 815. It should be known that clean water tank 620 could be fluidly connected to the outlet 814 of the valve 804 with the inlet 812 of the valve 804 being fluidly connected to the mixing Tee 796 so that fluid could flow in the opposite direction if desired.

In operation, when the pressure at the pressure port 822 is below a predetermined value such as between 7 to 10 psi, the valve 804 opens to allow water to flow in both directions. Such a pressure value at the pressure port 822 occurs when the main shut off valve 820 is opened and the pump 808 is turned on. The pump 808 also pressurizes the water mixed with detergent to draw it to the distributor 792. When the pressure exceeds a second predetermined value such as between 20 to 30 psi, the valve 804 closes. This would occur if the main shut off valve 820 is closed and the pump is turned on. Thus, with the valve 804 closed, the cleaning solution is prevented from flowing through it. Various types of pumps can be used such as a piston pump, gear pump or centrifugal pump.

Outlet 525 of the mixing Tee 796 is fluidly connected via flexible hose 823 to the inlet of the pump 808, which provides pressure to draw the cleaning solution to the distributor 792 when it is turned on. A relief valve 809 is fluidly connected across the pump 808 to limit the pressure at the outlet 807 of the pump 808 to a predetermined value. The outlet 807 of the pump 808 is fluidly connected to the main shut off valve 820 via flexible hoses 825, 874 and 876. Both of the shut off valves 800, 820 are in the form of a solenoid valve; however, other electrical actuated valves could be also used.

The valves 800, 820 are operated by a trigger switch 821 as depicted in FIG. 1. The trigger switch 821 is pivotally connected to the upper handle portion 358 approximately near a closed looped handgrip 824. Slide switch 858 is used to select one of the shut off valves 800, 822 to be opened and closed by the trigger switch 821. Slide switch 856 is the main power switch, which turns on and off the suction motor 90 (FIG. 3 from co pending application having Ser. No. 10/165,731 and U.S. Publication No. 20030226230) and pump 808.

The cleaning solution containing the clean water or water mixed with detergent flows to their associated shut off valves 800, 820. The cleaning liquid distributor 792 evenly distributes the cleaning solution to each of the rotary scrub brushes 72. The scrub brushes 72 then spread the cleaning solution onto the carpet (or bare floor), scrub the cleaning liquid into the carpet and dislodge embedded soil. A solution discharge valve 877 allows the mixed detergent and clean water to flow through an integrally formed nipple 218 and a detachable solution tube 216 to a hand-held cleaning attachment (not shown) and dispense by typical spray means.

The spray nozzles 221R, 221L are fluidly connected via solution tubes 217, 219 through respective outputs 213, 215 of a solenoid shut off valve 211. The solenoid shut off valve is fluidly connected to the solution discharge valve 877, which always allows cleaning solution to flow to the solenoid shut off valve 211. The valve 211 is electrically coupled to the power source 842 and microswitch 836 (FIG. 34 from co pending application having Ser. No. 10/165,731 and U.S. Publication No. 20030226230) and is operated by the trigger switch 821. Squeezing the trigger switch 821 causes the microswitch 836 to close the circuit between power source 842 and solenoid shutoff valve 211, which in turn energizes and opens the solenoid shut off valve 211 in a similar manner as that for the shutoff valves 800, 820. Thus, with the shut valve open, cleaning solution flows to the spray nozzles 221. Other types of shut off valves could be used such as, for example, a pressure actuated valve. Alternatively, an additional switch can be incorporated in the circuit between the solenoid shut off valve 211 and power source to operate the solenoid shutoff valve 211 instead of the trigger switch 821. Also, a switch can be electrically connected between the trigger switch and power source to selectively electrically connect and disconnect the trigger switch 821 from the circuit. In this manner, the user has the option to prevent the spray nozzles from spraying the cleaning solution onto the bristle bundles 237 when squeezing the trigger switch 821.

Figure 3:
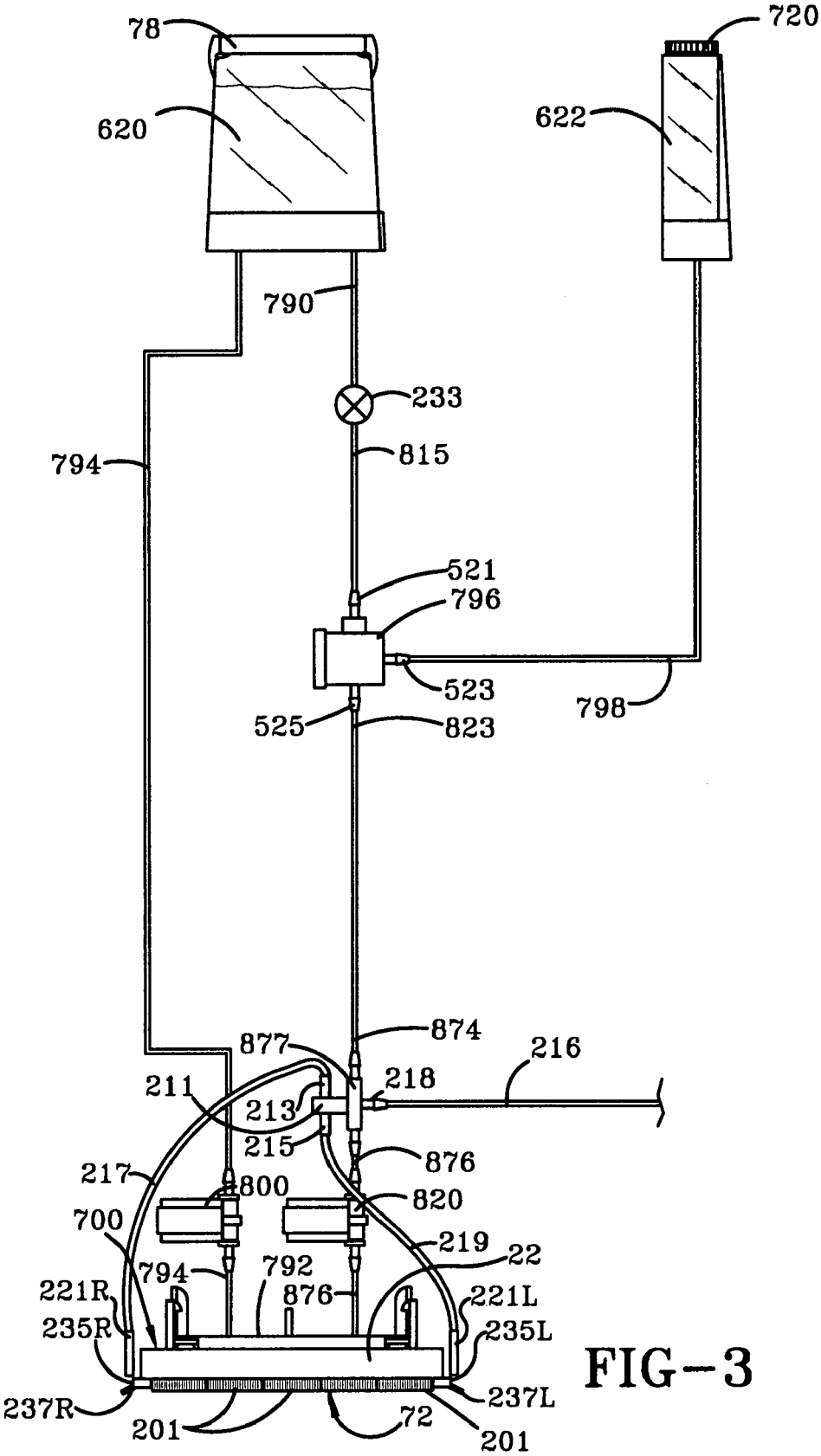
FIG. 3 is a schematics view of the fluid distribution system of another embodiment.
Figure 5:
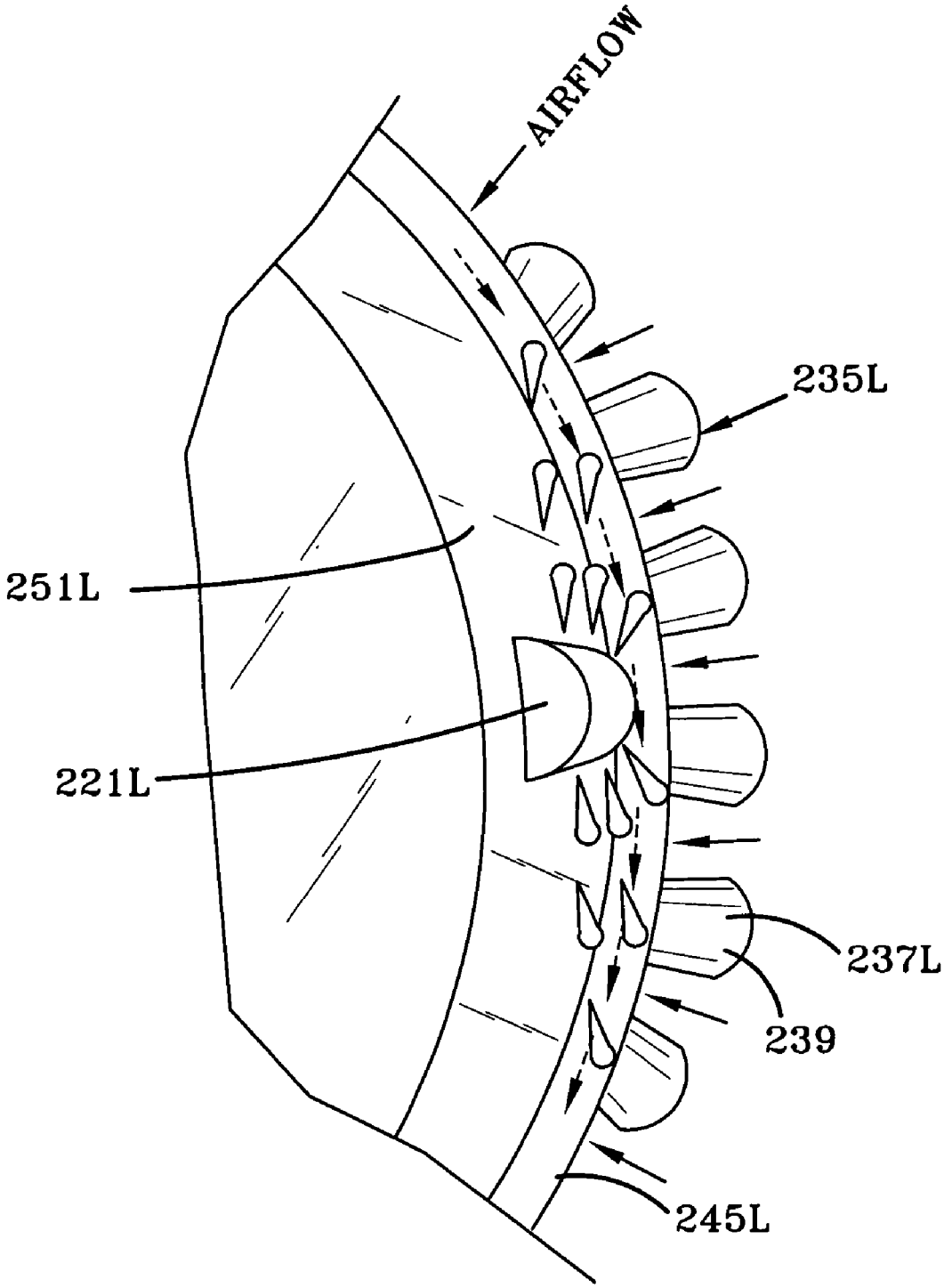
FIG. 5 is an enlarge top and left side perspective view of a portion of the base assembly of the embodiment of FIG. 3 showing the spray nozzle and other nearby elements of the invention.

FIGS. 3 and 5 show another embodiment of the invention. The carpet extractor 60 is similar to that shown in FIG. 1. Thus, similar reference numbers are used for common elements. In this embodiment, the pump is removed so that the cleaning solution flows by gravity to the spray nozzles and distributor. Also, the brush assembly 700 includes additional edge cleaning gear brushes 235L, 235R rotatably connected to the support beam 22 and rotate generally along an axis perpendicular to the surface 74 upon which the base assembly 64 is positioned. Each of these gear brushes 235 is basically configured as a spur gear, which intermeshes with its adjacent gear brush 201 such that when the center gear brush 201 rotates all other gear brushes including the edge brushes rotate accordingly. For gear brushes 201, each gear tooth has a blind bore, extending to an offset, into which bristle bundles are compressively inserted and extend downwardly to the surface. For the outer gear brushes 235L and 235R, each gear tooth has a blind bore, extending to an offset, into which bristle bundles 237L and 237R are compressively inserted. As seen in FIG. 5, these bristle bundles 237 extend downwardly and slope or flare outwardly beyond their respective side portions 251. This orientation allows the bristle bundles 237 to access edges, corner and other difficult places to scrub. Other details of this brush assembly 700 is taught in the above-mentioned U.S. Pat. No. 5,867,857.

Also, in this embodiment, the pump is removed so that the cleaning solution flows by gravity to the spray nozzles and distributor. Further, as seen in FIG. 3, a check valve, fluidly connected between the solution tubes 790 and 815, has been substituted for the pressure actuated shut off valve. Also, solution tube 806 and Tee 817, used to facilitate the operation of the shut off valve, have been removed. As seen in FIG. 5, the cleaning solution in this embodiment flows by gravity to the spray nozzle 221L. The spray nozzle 221L distributes the slower moving cleaning solution to the side portion 251L such that the solution cascades down the side portion 251L and wets the exposed portions 239 of the bristle bundles 237. In all other respects, the solution distribution system and common elements function the same as that for the embodiment shown in FIGS. 1, 2 and 4.

As is commonly known, a user turns on the carpet extractor 60 and pivots the handle 62 in an incline position while moving the carpet extractor 60 over the surface to clean it. The user squeezes the trigger switch 821 so that the carpet extractor 60 distributes the cleaning solution to the surface and substantially simultaneously extracts it along with the dirt on surface in a continuous operation. In particular, soiled cleaning solution is extracted from the surface by the suction nozzle 124 and transported into the recovery tank 80 where the liquid and air are separated. A vacuum is created in the recovery tank 80 by the suction motor, which draws air from the recovery tank 80 and exhausts the air to the surface 74. Further details of the carpet extractor are disclosed in co pending application having Ser. No. 10/165,731 and U.S. Publication No. 20030226230; the disclosure being incorporated herein by reference.

The present invention has been described by way of example using the illustrated embodiments. Upon reviewing the detailed description and the appended drawings, various modifications and variations of the embodiments will become apparent to one of ordinary skill in the art. All such obvious modifications and variations are intended to be included in the scope of the present invention and of the claims appended hereto.

In view of the above, it is intended that the present invention not be limited by the preceding disclosure of the embodiments, but rather be limited only by the appended claims.

What is claimed is:

1. A portable cleaning apparatus for cleaning a surface in which cleaning solution is dispensed to the surface and substantially simultaneously extracted along with any dirt on the surface in a continuous operation comprising:

a) a housing having a side portion;

b) a distributor operatively connected to said housing for distributing cleaning solution to said surface;

c) a solution container removably mounted to said housing and fluidly connected to said distributor for supplying a flow of cleaning solution to said distributor;

d) a recovery tank removably mounted to said housing;

e) a suction nozzle secured to said housing and in fluid communication with said recovery tank for transporting the cleaning solution and dirt from said surface into said recovery tank;

f) a suction source in fluid communication with said suction nozzle and recovery tank for drawing the cleaning solution and dirt from the surface through the suction nozzle and into the recovery tank;

g) an edge cleaner including a plurality of pliable elements for agitating the surface, said pliable elements contacting the surface beyond the side portion such that at least a portion of the pliable elements are disposed outside the housing in a direction substantially parallel with the surface; and h) a dispensing nozzle included on said suction nozzle and fluidly connected to said solution container, said dispensing nozzle dispensing cleaning solution from said solution container beyond the edge of said suction nozzle and onto said pliable elements.

2. The portable cleaning apparatus of claim 1 wherein said suction nozzle extends beyond the edge of said housing.

3. The portable cleaning apparatus of claim 1 wherein said edge cleaner includes at least one brush, said brush being rotatably connected to said housing, said pliable elements being secured to said brush.

4. The portable cleaning apparatus of claim 1 wherein said housing includes a base portion for movement along a surface and a handle portion pivotally connected to said base portion.

5. The portable cleaning apparatus of claim 1 wherein said pliable elements have outer bristle bundles extending downwardly and sloping or flaring outwardly beyond the side portion.

6. The portable cleaning apparatus of claim 1 including a brush assembly with outer bristle bundles extending downwardly and sloping or flaring outwardly beyond the side portion.

7. The portable cleaning apparatus of claim 1 wherein the dispensing nozzle is positioned at one side of the suction nozzle and a second dispensing nozzle is positioned at another side of the suction nozzle, the dispensing nozzle and the second dispensing nozzle configured to spray cleaning solution in a fanning pattern down to pliable elements of the edge cleaner that are exposed portions of bristle bundles extending beyond the respective side portion of the suction nozzle thereby wetting said exposed portions of bristle bundles of the edge cleaner for contacting the surface beyond the edge of said suction nozzle.

8. A portable cleaning apparatus for cleaning a surface comprising:

a) a housing for movement along the surface and including a side portion;

b) a solution container mounted to said housing and containing a solution;

c) a dispensing nozzle provided on said housing and fluidly connected to said solution container, wherein said dispensing nozzle dispenses solution beyond the side portion in a direction substantially parallel with the surface; and d) an edge cleaner provided at the edge of said housing, said edge cleaner including a plurality of pliable elements contacting the surface beyond the side portion in a direction substantially parallel with the surface, wherein said dispensing nozzle is configured to dispense cleaning solution onto said pliable elements.

9. The portable cleaning apparatus of claim 6 wherein said edge cleaner includes at least one brush, said brush being rotatably connected to said housing, said pliable elements being secured to said brush.

10. The portable cleaning apparatus of claim 8 wherein said pliable elements outer bristle bundles extending downwardly and sloping or flaring outwardly beyond the side portion.

11. The portable cleaning apparatus of claim 8 wherein the dispensing nozzle is positioned at one side of the housing and a second dispensing nozzle is positioned at another side of the housing, the dispensing nozzle and the second dispensing nozzle configured to spray cleaning solution in a fanning pattern down to pliable elements of the edge cleaner that are exposed portions of bristle extending beyond the housing thereby wetting said exposed portions of bristle bundles of the edge cleaner for contacting the surface beyond the edge of said housing.

12. The portable cleaning apparatus for cleaning a surface comprising:

a) a housing for movement along the surface;

b) a solution container mounted to said housing and containing a solution;

c) a dispensing nozzle provided on said housing and fluidly connected to said solution container, wherein said dispensing nozzle dispenses solution beyond the edge of said housing; and d) an edge cleaner provided at an edge of said housing and including a plurality of pliable elements for agitating the surface, said pliable elements contacting the surface beyond the edge of said housing wherein said edge cleaner includes at least one brush, said brush being rotatably connected to said housing, said pliable elements being secured to said brush, wherein said brush rotates on an axis perpendicular to the surface.

13. The portable cleaning apparatus of claim 6 wherein said housing includes a body portion partially covering said brush, said body portion having a side end, said dispensing nozzle being mounted on said side end.

14. A portable cleaning apparatus for cleaning a surface in which cleaning solution is dispensed to the surface and substantially simultaneously extracted along with any dirt on the surface in a continuous operation comprising:

a) housing;

b) a distributor operatively connected to said housing for distributing cleaning solution to said surface;

c) a solution container removably mounted to said housing and fluidly connected to said distributor for supplying a flow of cleaning solution to said distributor;

d) a recovery tank removably mounted to said housing;

e) a suction nozzle secured to said housing and in fluid communication with said recovery tank for transporting the cleaning solution and dirt from said surface into said recovery tank;

f) a suction source in fluid communication with said suction nozzle and recovery tank for drawing the cleaning solution and dirt from the surface through the suction nozzle and into the recovery tank;

g) an edge cleaner provided at an edge of said suction nozzle and including a plurality of pliable elements for agitating the surface, said pliable elements contacting the surface beyond the edge of said suction nozzle, wherein said edge cleaner includes at least one brush, said brush being rotatably connected to said housing to rotate on an axis perpendicular to the surface, and said pliable elements being secured to said brush; and h) a dispensing nozzle provided on said suction nozzle and fluidly connected to said solution container, said dispensing nozzle dispensing cleaning solution from said solution container beyond the edge of said suction nozzle and onto said pliable elements.

15. The portable cleaning apparatus of claim 14 wherein said pliable elements of the edge cleaner contacting the surface beyond the edge of said housing have outer bristle bundles extending downwardly and sloping or flaring outwardly beyond the edge of said housing.

* * * * *